US009943901B2

(12) United States Patent
Harrison et al.

(10) Patent No.: US 9,943,901 B2
(45) Date of Patent: Apr. 17, 2018

(54) ADJUSTABLE STAMPING DIE

(71) Applicant: FORD GLOBAL TECHNOLOGIES, LLC, Dearborn, MI (US)

(72) Inventors: Nia R. Harrison, Ann Arbor, MI (US); Andrey M. Ilinich, Novi, MI (US); Dennis Cedar, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 3 days.

(21) Appl. No.: 14/840,717

(22) Filed: Aug. 31, 2015

(65) Prior Publication Data

US 2017/0056951 A1 Mar. 2, 2017

(51) Int. Cl.

| | |
|---|---|
| ***B21D 22/22*** | (2006.01) |
| ***B21D 24/04*** | (2006.01) |
| ***B21D 37/02*** | (2006.01) |
| ***B21D 37/16*** | (2006.01) |
| ***B21D 22/20*** | (2006.01) |
| *B21D 35/00* | (2006.01) |

(52) U.S. Cl.

CPC ..... *B21D 37/02* (2013.01); *B21D 22/208* (2013.01); *B21D 22/22* (2013.01); *B21D 24/04* (2013.01); *B21D 37/16* (2013.01); *B21D 35/005* (2013.01)

(58) Field of Classification Search

CPC ..... B21D 37/02; B21D 37/10; B21D 37/16; B21D 37/04; B21D 37/12; B21D 37/14; B21D 37/18; B21D 24/16; B21D 22/06; B21D 22/022; B21D 22/208; B21D 22/02; B21D 22/22

USPC ..... 72/347, 446

See application file for complete search history.

(56) References Cited

U.S. PATENT DOCUMENTS

| | | | | |
|---|---|---|---|---|
| 3,319,501 | A | 5/1967 | Risher | |
| 6,065,324 | A * | 5/2000 | Russell | B21D 5/042 72/313 |
| 6,250,618 | B1 | 6/2001 | Greenhill | |
| 6,810,709 | B2 * | 11/2004 | Hammar | B21D 37/16 72/342.7 |
| 7,587,820 | B2 | 9/2009 | Ooyauchi et al. | |
| 8,001,821 | B2 * | 8/2011 | Kondo | B21D 37/16 72/342.2 |
| 8,381,562 | B2 * | 2/2013 | Schroth | B21D 37/16 72/342.1 |
| 2010/0064759 | A1 * | 3/2010 | Kondo | B21D 22/208 72/342.3 |

FOREIGN PATENT DOCUMENTS

| | | | | |
|---|---|---|---|---|
| CN | 101879547 A | | 11/2010 | |
| CN | 102145360 A | | 8/2011 | |
| FR | 73003 E | * | 9/1960 | B21D 24/16 |

* cited by examiner

*Primary Examiner* — Teresa M Ekiert

(74) *Attorney, Agent, or Firm* — Marla Johnston; Brooks Kushman P.C.

(57) ABSTRACT

A stamping die is provided. The stamping die includes a die block, a punch, and a trap wall. The punch is configured to engage the die block in order to form a part from a sheet metal blank. The trap wall is secured to the punch and configured to restrict the flow of sheet metal into the die block during punch and die block engagement. The trap wall is adjustable with respect to the punch such that a trap wall adjustment alters the flow of sheet metal into the die block.

8 Claims, 3 Drawing Sheets

ADJUSTABLE STAMPING DIE

TECHNICAL FIELD

The present disclosure relates to stamping dies that are used to form parts from sheet metal.

BACKGROUND

Stamping dies are often utilized for forming parts from sheet metal blanks. For example, the automotive industry often uses stamping dies to form vehicle body components.

SUMMARY

A stamping die is provided. The stamping die includes a die block, a punch, and a trap wall. The punch is configured to engage the die block in order to form a part from a sheet metal blank. The trap wall is secured to the punch and configured to restrict the flow of sheet metal into the die block during punch and die block engagement. The trap wall is adjustable with respect to the punch such that trap wall adjustment alters the flow of sheet metal into the die block.

A stamping die is provided. The stamping die includes a die block, a punch, and a pair of adjustable trap walls. The die block defines a cavity and the punch is configured to engage the die block such that sheet metal blank forms a part inside the cavity. The pair of adjustable trap walls is secured to opposing sides of the punch and is configured to restrict sheet metal flow into the cavity. The trap walls are adjustable relative to the punch such that adjustment of the trap walls alters the flow of sheet metal into the cavity.

A two-sided stamping die is provided. The die set is configured to form a part from a 7xxx series aluminum alloy blank upon the closing of the die set. The die set defines cooling channels that are configured to cool the die set such that the die set quenches the part upon the closing of the die set. A pair of adjustable trap walls is secured to opposing ends of a first side of the die set and is configured to contact a top surface of the aluminum alloy blank upon closing the die set such that the flow of the aluminum alloy blank is restricted. An adjustment of the trap walls relative to the die set alters the flow of aluminum alloy blank into the die set.

DETAILED DESCRIPTION

Figure 1:
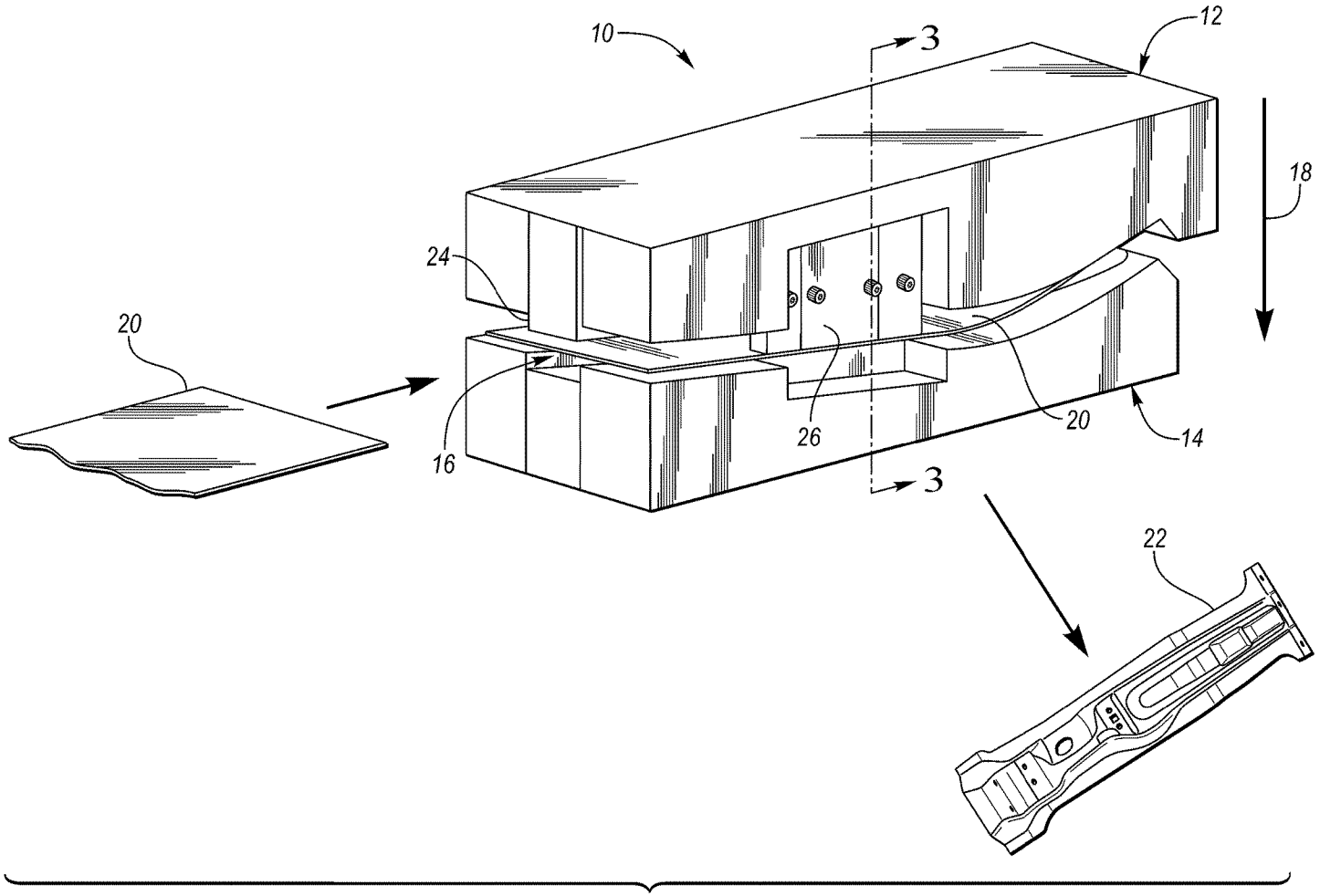
FIG. 1 is an isometric view of a stamping die, and further illustrates a sheet metal blank and a part formed from the sheet metal blank in the stamping die.

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Hot stamping is a manufacturing process that involves simultaneously forming a part from a pre-heated sheet metal blank and quenching the pre-heated sheet metal blank in a two-sided stamping die. The high pressure contact between the stamping die and the sheet metal blank conductively cools and quenches the blank. Formability of the part in the stamping die may be improved by tailoring the blank shape to be more consistent with the final part shape. Alternatively, the surface of the die may be modified to improve formability.

Dies may be constructed to dimensions that are based on a model generated by a computer aided design program and assessed by a finite element analysis program. Constructing the die based on the computer model is typically accurate for dies used in conventional room temperature forming processes but is typically not as accurate for dies used in elevated temperature forming processes. Since the computer model may not be accurate for constructing dies used for elevated temperature forming processes, additional machining will likely be required. Additional machining of a die to arrive at the correct dimensions for the desired formability is a process of trial an error that leads to increased set up times.

Including adjustable trap walls on the die allows for modification of the die without additional machining. The sheet metal blank may be constrained or released by the adjustable trap walls in order to support formability within the die. The adjustable trap walls may be adjusted in order to catch the sheet metal blank and restrict sheet metal flow into the cavity. The trap walls may also be adjusted in order to create a gap between the die surface and the sheet metal blank to allow for more sheet metal material to flow into the die. The addition of adjustable trap walls to the die allows for decreased set ups times by eliminating the need for additional machining of the die in order to obtain the desired formability.

Referring to FIG. 1, an isometric view of a stamping die 10 is illustrated. The stamping die 10 may be a two-sided stamping die. The stamping die 10 includes a die set that comprises a first side and a second side. The first side of the die set may be a punch 12 and the second side of the die set may be a die block 14 that defines a cavity 16. The punch 12 is configured to engage the die block 14 in a longitudinal direction 18 such that a sheet metal blank 20 that is disposed between the punch 12 and the die block 14 forms a part 22 having a desired shape. Punch 12 and die block 14 engagement may also be referred to as closing the die set and the longitudinal direction 18 may also be referred to as the direction of closing the die set. The sheet metal blank 20, and ultimately the part 22, may be any sheet metal material that is capable of being formed in a stamping process including, but not limited, to steel, magnesium, magnesium alloys, aluminum, and aluminum alloys. The aluminum alloys may include 2000, 3000, 4000, 5000, 6000, and 7000 series aluminum alloys. The punch 12 may include a post portion 24 that includes a contoured surface that matches and conforms to the shape of the cavity 16 when the punch 12 is engaging the die block 14 in order to transform the sheet metal blank 20 disposed between the punch 12 and die block 14 into the final part 22.

The stamping die 10 may also include at least one trap wall 26 that is configured to restrict the flow of the sheet metal blank 20 into the die block 14 and cavity 16 during punch 12 and die block 14 engagement. The trap walls 26 may be secured to the punch 12 and configured to contact a top surface of the sheet metal blank 20 during punch 12 and die block 14 engagement. The trap walls 26 may also be adjustable such that a trap wall adjustment with respect to the punch 12 alters the flow of the sheet metal blank 20 into the die block 14 and cavity 16.

Figure 2B:
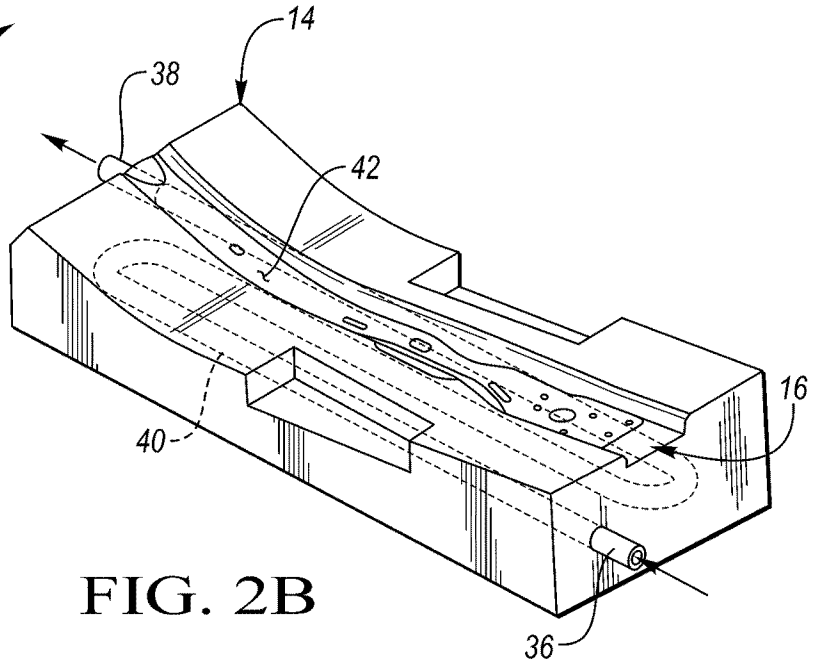
FIG. 2B is an isometric view of the die block and cavity portion of the stamping die.
Figure 2A:
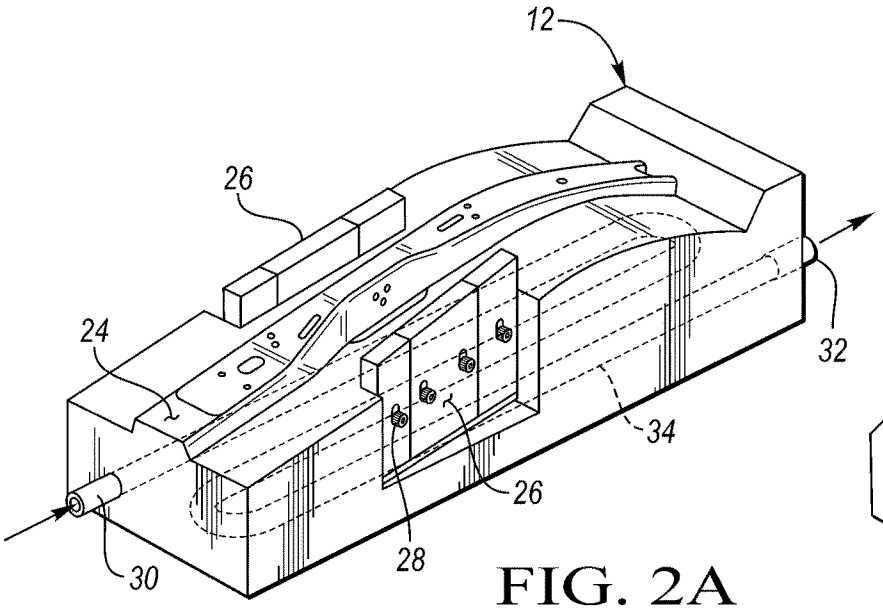
FIG. 2A is an isometric view of the punch portion of the stamping die.

Referring to FIGS. 2A and 2B the punch 12 and die block 14 are illustrated with the punch 12 rotated 180° so that the post portion 24 of the punch 12 is facing upwards. In this embodiment a pair of trap walls 26 is secured to the opposing sides of the punch 12. The trap walls 26 may be secured to the punch 12 via fasteners 28. The punch 12 may include an inlet 30 and an outlet 32 that are connected to an internal cooling channel 34. The internal cooling channel 34 of the punch 12 may be configured to route a liquid coolant in order to reduce the surface temperature of the punch 12 (which may include the post portion 24). The die block 14 may also include an inlet 36 and an outlet 38 that are connected to an internal cooling channel 40. The internal cooling channel 40 of the die block 14 may be configured to route a liquid coolant in order to reduce the surface temperature of the die block 14 (which may include a surface 42 that defines the cavity). The cooling channel 34 of the punch 12 and the cooling channel 40 of the die block 14 may be configured to reduce the surface temperatures of the punch 12 and die block 14 such that the punch 12 and die block 14 cool the part 22 formed in the stamping die 10 during punch 12 and die block 14 engagement. Furthermore, the sheet 20 may be preheated before entering the stamping die 10 and cooled in the stamping die 10 as part of a heat treating process. For example, the sheet metal blank 20 may be made from a 7000 series aluminum alloy, such as 7075 aluminum alloy, that is heated as part of a heat treat process prior to being quenched in the stamping die 10. The part 22 formed in the stamping die may then be subsequently aged in order to obtain a T6 or T7 temper.

Figure 3:
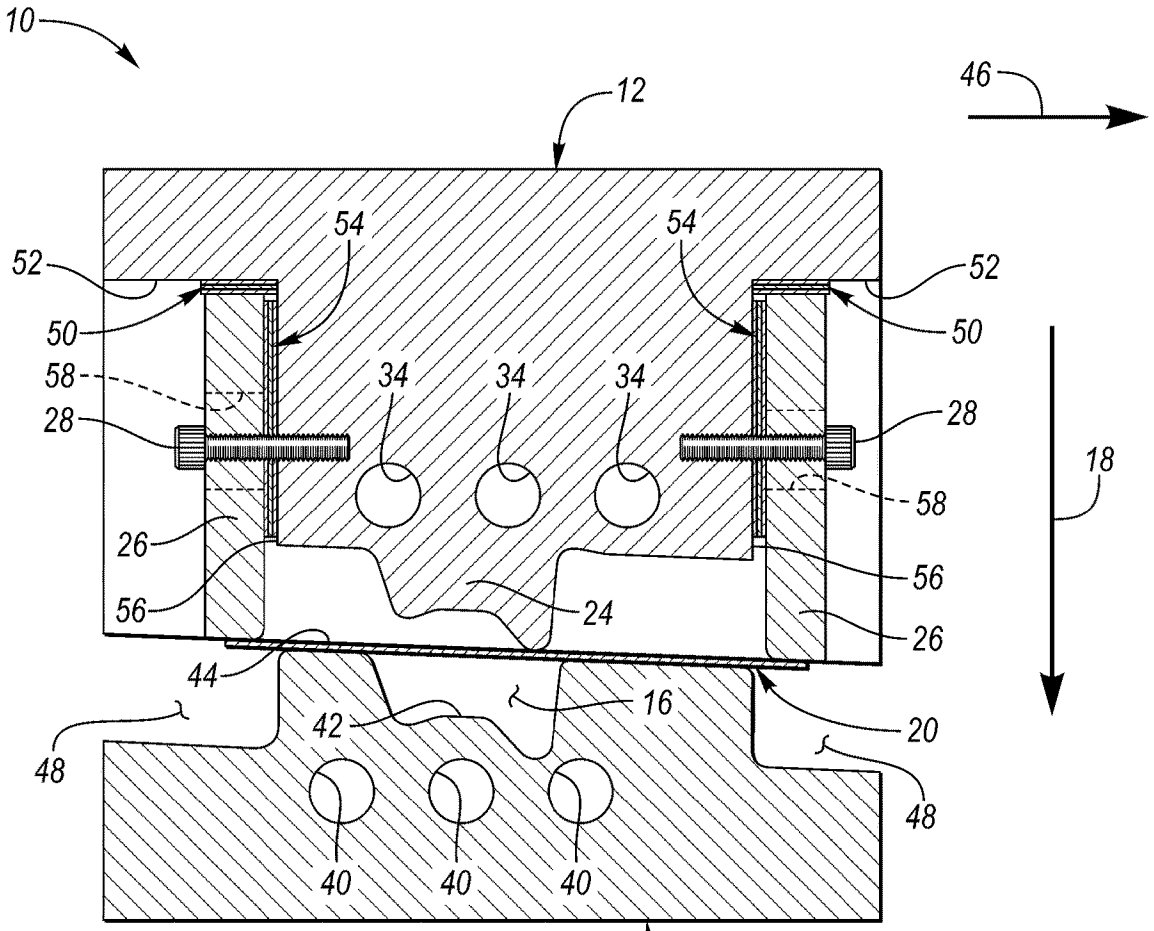
FIG. 3 is cross-sectional view taken along line 3-3 in FIG. 1.

Referring to FIG. 3, a cross-sectional view of the stamping die 10 taken along line 3-3 of FIG. 1 is illustrated. The punch 12 has been shifted in the longitudinal direction 18 with respect to the die block 14, such that the trap walls 26 are contacting a top surface 44 of the sheet metal blank 20. The trap walls 26 may be adjustable in the longitudinal direction 18 with respect to the punch 12. The trap walls 26 may also be adjustable in a lateral direction 46 with respect to the punch 12. The die block 14 may include recesses 48 to provide clearance for the trap walls 26 during punch 12 and die block 14 engagement.

A first set of shims (which comprises at least one shim) 50 may be disposed between the trap walls 26 and horizontal surfaces 52 of the punch 12 such that a movement of one of the shims 50 results in an adjustment of the trap walls 26 in the longitudinal direction 18. A second set of shims (which comprises at least one shim) 54 may be disposed between the trap walls 26 and vertical surfaces 56 of the punch 12 such that a movement of one of the shims 54 results in an adjustment of the trap walls 26 in the lateral direction 46. The trap walls 26 may define slots 58 that extend in the longitudinal direction 18. The fasteners 28 that secure the trap walls 26 to the punch 12 may pass through the slots 58 and engage the punch 12 such that the trap walls 26 are movable along the slots 58 in the longitudinal direction 18.

Alternatively, adjustment mechanisms other than shims may be used to adjust the trap walls 26 in either the longitudinal direction 18 or lateral direction 46. For example, the adjustment mechanisms may include grind blocks that may be used to adjust traps walls 26 to the correct dimensions by removing material from the grind blocks via a grinding process, or the adjustment mechanisms may be push-pull blocks that engage the trap walls 26 via fasteners and are capable of adjusting the trap walls 26 relative to the push-pull blocks via the fasteners. The disclosure should not be construed as limited to the types of adjustment mechanisms listed above but should include any type of mechanism that is capable of adjusting the trap walls 26 relative to the punch 12.

The words used in the specification are words of description rather than limitation, and it is understood that various changes may be made without departing from the spirit and scope of the disclosure. As previously described, the features of various embodiments may be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A stamping die comprising:

a die block;

a punch configured to engage the die block in a longitudinal direction;

a first adjustable trap wall secured to the punch and configured to restrict flow of sheet metal into the die block during engagement; and first and second adjustment mechanisms secured to the punch and respectively movable to adjust the first trap wall in the longitudinal direction and a lateral direction relative to the punch, wherein the first adjustment mechanism comprises at least one shim disposed between the first adjustable trap wall and a horizontal surface of the punch such that movement of the at least one shim results in an adjustment of the first adjustable trap wall in the longitudinal direction.

2. The stamping die of claim 1, wherein the first adjustable trap wall defines a slot extending in the longitudinal direction, and wherein a fastener passing through the slot and engaging the punch secures the first adjustable trap wall to the punch such that the first adjustable trap wall is moveable along the fastener in the longitudinal direction.

3. The stamping dies of claim 1, wherein the second adjustment mechanism comprises at least one shim disposed between the first adjustable trap wall and a vertical surface of the punch such that movement of the at least one shim results in an adjustment of the first trap wall in the lateral direction.

4. The stamping die of claim 1, further comprising a second adjustable trap wall secured to the punch on an opposing side of the punch relative to the first adjustable trap wall and configured to restrict the flow of sheet metal into the die block during punch and die block engagement, wherein a second trap wall adjustment with respect to the punch alters the flow of sheet metal into the die block.

5. The stamping die of claim 4, wherein the second adjustable trap wall is adjustable in the longitudinal direction with respect to punch.

6. The stamping die of claim 5, wherein the second adjustable trap wall is adjustable in the lateral direction with respect to punch.

7. The stamping die of claim 1, wherein the die block and the punch each include internal cooling channels configured to reduce surface temperatures of the die block and the punch such that the die block and the punch quench a sheet metal part that is formed during punch and die block engagement.

8. A two-sided stamping die comprising:

a die set defining cooling channels configured to cool the die set such that the die set quenches a part upon closing the die set in a longitudinal direction;

a pair of adjustable trap walls secured to opposing ends of a first side of the die set and configured to contact a surface of a sheet metal blank upon closing the die set such that flow of the blank into the die set is restricted, wherein the trap walls are adjustable in the longitudinal direction and a lateral direction with respect to the die set;

a first set of shims disposed between the pair of trap walls and horizontal surfaces of the die set to provide for adjustment in the longitudinal direction such that movement of one of the shims results in an adjustment of at least one of the pair of trap walls in the longitudinal direction; and a second set of shims disposed between the pair of trap walls and vertical surfaces of the die set to provide for adjustment in the lateral direction such that movement of one of the shims of the second set of shims results in an adjustment of at least one of the pair of trap walls in the lateral direction.

* * * * *